United States Patent [19]

Ito et al.

[11] 4,127,839

[45] Nov. 28, 1978

[54] THERMAL SWITCH

[76] Inventors: Hideo Ito, 1-12, 2-chome, Higashi, Shibuya-ku, Tokyo; Shinji Hashiba, 407, 36-2, 1-chome, Higashi-Kanamachi, Katsushika-ku, Tokyo, both of Japan

[21] Appl. No.: 799,840

[22] Filed: May 23, 1977

[51] Int. Cl.[2] ..... H01H 37/76

[52] U.S. Cl. ..... 337/408; 337/409

[58] Field of Search ..... 337/408, 409, 407, 401, 337/403, 402, 404, 405, 410, 388

[56] References Cited

U.S. PATENT DOCUMENTS

| | | | |
|---|---|---|---|
| 3,727,164 | 4/1973 | Cartier et al. | 337/409 |
| 3,924,218 | 12/1975 | Plasko | 337/409 |
| 4,068,204 | 1/1978 | Iwanari et al. | 337/409 |

*Primary Examiner*—Harold Broome

*Attorney, Agent, or Firm*—Pollock, Vande Sande and Priddy

[57] ABSTRACT

Conductive caps are respectively put on both ends of an insulating cylindrical member and a pair of cup-shaped contactors are disposed in the insulating cylindrical member in a manner to be movable relative to each other. A repulsive force is provided by a pair of biasing elements located between the pair of cup-shaped contactors through a fusible member to electrically interconnect the conductive caps. When the fusible member is fused at a predetermined temperature, the biasing force of one of the biasing elements weakens and the biasing force of the other biasing element increases to move the pair of cup-shaped contactors toward each other, thereby to electrically disconnect the conductive caps from each other.

8 Claims, 8 Drawing Figures

THERMAL SWITCH

BACKGROUND OF THE INVENTION

This invention relates to a thermal switch for detecting an abnormal temperature rise of, for instance, fire detectors or electric heating appliances.

In conventional types of fuses widely used, a band-shaped metallic conductor of a relatively low fusing point such as lead is employed as a fusible member and terminals are attached to both ends of the band-shaped fusible member for attachment to connecting portions of a circuit. A weight is attached to the fusible member at the center thereof and when the fusible members starts to fuse, the weight falls off the fusible member due to its weight to rapidly divide the fusible member to cut off the circuit, thereby actuating a fire alarm or automatically cutting off the power supply to an electrical heating appliance.

Since the fusing point of the abovesaid metallic conductor is 110° C. or higher at the lowest, it is impossible to provide a fuse which operates at a temperature below the above-said one. Accordingly, where such a metallic conductor is used in a fire detector, a warning cannot be immediately given. In addition to this, the surface of the fuse of such a metallic conductor is readily oxidized to form thereon an oxide film. Accordingly, there is the possibility that even when the fusing temperature is reached, only the inner part of the fuse is fused but that its surface remains unfused. In such a case, the circuit is not cut off, which entails a danger such as a delay in the detection of a fire or overheating of an electric heating appliance. Further, in the case of a fuse formed of an alloy which is composed of lead and, for example, tin or the like, for the purpose of lowering the fusing temperature, the mixed component may be evaporated in some cases, with the result that the mixed component decreases to raise the fusing temperature. For instance, if a fuse having a fusing temperature of 110° C. is left, for example at 90° C. for ten days, the fusing temperature sometimes varies from 110° C. to 160° C. To avoid this, there has been proposed a thermal switch of the type which employs an insulating fusible powder having a low fusing point such, for example, as paraffin, and which is adapted so that contactors are prevented by the fusible powder from movement to maintain the circuit in its conducting state and that when the fusible power is fused by a temperature rise, the contactors shift to cut off the circuit. With the use of paraffin, it is possible to obtain a fire detector which operates at a relatively low temperature, for instance, about 50° C., and which has the advantage of detecting a fire at its early stage.

The prior art thermal switch employing an insulating fusible powder such as paraffin comprises an insulating cylindrical member fabricated of a material such as glass or ceramics, conductive caps attached to both ends of the insulating cylindrical member, three cup-shaped conductors disposed in the insulating cylindrical member to electrically interconnect the conductive caps and disconnect them from each other when the insulating fusible powder is fused, a first bias spring for holding the three contactors in contact with one another to retain the conductive caps in their electrically conductive state when the insulating fusible powder remains unfused, and a second bias spring for bringing the contactors out of contact with one another when the insulating fusible member is fused.

With such a structure, it is possible to obtain a thermal switch which employs a small insulating cylindrical member about 6 mm in diameter and about 12 mm in length and has a current capacity of approximately 10 amperes. However, this thermal switch has the defect that the operation of incorporating the three cup-shaped contactors in the insulating cylindrical member is very troublesome. Further, the use of the three contactors increases the number of contact points, which leads to the defect that their contact resistances increase the resistance value between the conductive caps.

One object of this invention is to provide a thermal switch of the abovesaid type employing an insulating fusible powder and in which the number of cup-shaped contactors mounted in the insulating cylindrical member is reduced to simplify the assembling operation and decrease the contact resistance between the conductive caps.

Another object of this invention is to provide a thermal switch which ensures disconnection of the contactors when the insulating fusible powder is fused.

Another object of this invention is to provide a thermal switch wherein the range of dispersion of the operation temperature is narrow.

Still another object of the invention is to provide a thermal switch which has an excellant moistureproof characteristic and whose operating temperature does not change with the lapse of time.

SUMMARY OF THE INVENTION

In accordance with this invention, conductive caps are respectively attached to both ends of an insulating cylindrical member and two cup-shaped contactors, each closed at one end, are mounted in the insulating cylindrical member to electrically interconnect the conductive caps and to disconnect them from each other when an insulating fusible powder is fused. The diameter of the cylindrical body of a first one of the cup-shaped contactors is selected a little larger than the diameter of the cylindrical body of the second one of the contactors. The closed end portion of the second contactor is inserted into the first contactor in such a manner that the second contactor is slidable in the first one in its axial direction. The insulating fusible powder is packed in the first contactor at the side of its closed end, and a first bias spring is interposed between the insulating fusible powder and the closed end of the second contactor to produce a repulsive force between the two contactors, by which the conductive caps are electrically interconnected through the contactors and held in their conducting state. In the second contactor, a spherical insulator and a second bias spring is applied to one of the conductive caps through the spherical insulator and to the closed end of the second contactor in the direction of the closed end of the first contactor. Accordingly, when the insulating fusible powder is fused to reduce its volume, the compression stress applied to the first bias spring is weakened and the second contactor is moved inwardly of the first contactor by the biasing force of the second bias spring to disengage the second contactor from the conductive cap.

DESCRIPTION OF THE PREFERRED EMBODIMENTS

Figure 1:
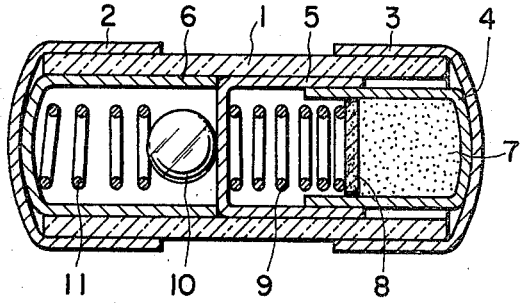
FIG. 1 PRIOR ART
FIG. 1 is a sectional view of a conventional thermal switch.

FIG. 1 illustrates a conventional thermal switch which employs an insulating powder as a fusible member. In FIG. 1, reference numeral 1 indicates an insulating cylindrical member fabricated of glass or ceramics, the both ends of which are closed by conductive caps 2 and 3. This example shows the case of a thermal switch which is removably inserted into a circuit, with the conductive caps 2 and 3 held by a fuse holder. It is also known, however, to provide a thermal switch of this same general type wherein lead wires are respectively led out from the conductive caps in the axial direction of the insulating cylindrical member. Inserted in the insulating cylindrical member 1 are first, second and third contactors 4, 5 and 6 for electrically interconnecting the conductive caps 2 and 3. These three contactors 4, 5 and 6 are each cup-shaped with one end closed. The first contactor 4 is disposed with its closed end held in contact with the inside of one conductive cap 3. The second contactor 5 has its inner diameter selected a little larger than the outer diameter of the first contactor 4. As illustrated, the first and second contactors 4 and 5 are disposed with their open ends facing toward each other and the first contactor 4 is inserted into the second contactor 5 with the outer peripheral surface of the former held in sliding contact with the inner peripheral surface of the latter so that the second contactor 5 may be moved in the axial direction of the insulating cylindrical member 1. The third contactor 6 is disposed with its closed end held in contact with the inside of the other conductive cap 2 and its open end facing toward the closed end of the second contactor 5. The diameters of the second and third contactors 4 and 6 are selected substantially equal to each other.

A fusible member 7 composed of an insulating powder such, for example, as paraffin, is packed in the first contactor 4 on the side of its closed end and, if necessary, a cover 8 formed of an insulating material is put on the fusible member 7. A first bias spring 9 is inserted between the cover 8 and the closed end of the second contactor 5 to urge the second contactor 5 against the third contactor 6 at all times, thereby ensuring maintenance of the electrical connection between the conductive caps 2 and 3. An insulator 10 is inserted into the third contactor 6. This insulator 10 is formed spherical so that it may be readily inserted into the third contactor 6. Such a spherical insulator 10 made of, for example, glass is disposed on the side of the second contactor 5. A second bias spring 11 is inserted between the spherical insulator 10 and the closed end of the third contactor 6. The biasing force of the second bias spring 11 is selected smaller than that of the first bias spring 9. With such an arrangement, while the fusible member 7 remains unfused, the second and third contactors 5 and 6 are maintained in contact with each other by the biasing force of the first bias spring 9. When the fusible member 7 is fused due to a temperature rise to reduce its volume, permitting the cover 8 to be moved toward the closed end of the first contactor 4, the biasing force of the first bias spring 9 decreases to a value smaller than that of the second bias spring 11. As a result of this, the second contactor 5 is moved by the biasing force of the second bias spring 11 to disengage the second and third contactors 5 and 6 from each other, thus detecting the temperature rise.

The thermal switch described above requires three cup-shaped contactors 4, 5 and 6, and hence needs many parts. This inevitably raises the manufacturing cost and involves troublesome assembling steps. Further, an increase in the number of contactors increases the number of contact points to result in the defect of increased resistance value between the conductive caps 2 and 3. Moreover, even when the fusible member 7 is fused into a fluid, if its viscosity is high, the fluid does not readily escape from the clearance between the cover 8 and the first contactor 4 and the second and third contactors 5 and 6 are not positively disengaged from each other in some cases. Thus, the conventional thermal switch is low in reliability, too.

In view of the above, the present invention is intended to achieve electrical connection and disconnection between the conductive caps by the employment of two contactors.

Figure 2:
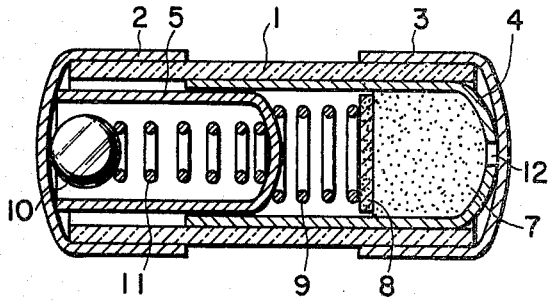
FIG. 2 is a sectional view illustrating an embodiment of a thermal switch of this invention.

FIG. 2 illustrates an embodiment of this invention. In FIG. 2, the parts corresponding to those in FIG. 1 are marked with the same reference numerals and no detailed description will be repeated. The thermal switch of this invention is identical with the conventional thermal switch of FIG. 1 in that the first contactor 4 is disposed in the insulating cylindrical member 1 with its closed end in contact with the closed end of the conductive cap 3, the fusible member 7 in the form of a powder is packed in the first contactor 4 on the side of its closed end, the cover 8 is put on the fusible member 7, and the first bias spring 9 is urged at one end against the cover 8. However, the thermal switch of this invention is characterized in that the closed end portion of the second contactor 5 is inserted into the first contactor 4, the first bias spring 9 is interposed between the cover 8 and the closed end of the second contactor 5 to press the marginal edge of the open end of the second contactor 5 against the inner surface of the closed end of the other conductive cap 2, the spherical insulator 10 is disposed in the second contactor 5 at the side of its open end portion, and the second bias spring 11 is interposed between the spherical member 10 and the second contactor 5. Accordingly, in the present invention, the outer diameter of the second contactor 5 is selected a little smaller than the inner diameter of the first contactor 4, permitting sliding movement of the second contactor 5 with its outer peripheral surface in sliding contact with the inner surface of the first contactor 4.

Figure 3:
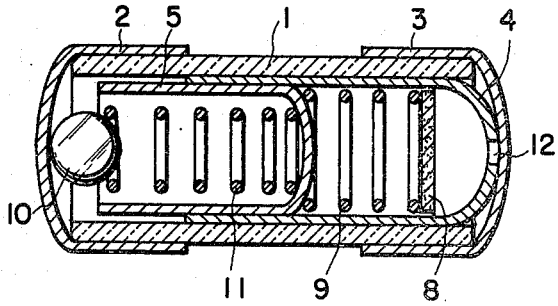
FIG. 3 is a sectional view showing the operative state of the thermal switch of this invention.

With such an arrangement, while the fusible member 7 remains unfused, the marginal edge of the open end portion of the second contactor 5 is urged against the inner surface of the closed end of the conductive cap 2 by the biasing force of the first bias spring 9, thereby to ensure maintenance of the electrical connection between the conductive caps 2 and 3. When the fusible member 7 is fused to decrease its volume to permit the cover 8 to move toward the closed end of the first contactor 4 and the biasing force of the first bias spring 9 becomes smaller than that of the second bias spring 11, the second contactor 5 is moved by the biasing force of the second bias spring 11 toward the inside of the first contactor 4. With this movement, the marginal edge of the open end portion of the second contactor 5 is disengaged from the conductive cap 2, as shown in FIG. 3.

As described above, the present invention employs the two contactors 4 and 5 to electrically connect the conductive caps 2 and 3 to each other and, when the fusible member 7 is fused, the caps are disconnected from each other. Accordingly, this invention enables simplification of the construction of the thermal switch and its assembling, as compared with the conventional thermal switch of this type. Further, since the number of contacts is reduced, the number of contact points is reduced correspondingly to provide for decreased electrical resistance value between the conductive caps 2 and 3.

Another feature of the thermal switch of this invention lies is that a hole 12 is formed in the closed end of the first contactor 4. When the fusible member 7 begins to fuse, it is drained out from the first contactor 4 through the hole 12 to ensure disconnection of the conductive caps 2 and 3, providing for enhanced reliability.

The contact resistance between the first and second contactors 4 and 5 may be further reduced by providing slits in the cylindrical body of either one of the first and seond contactors 4 and 5. The formation of such slits provides resiliency in the cylindrical body of the contactor in its radial direction to produce a contact pressure between the first and second contactors 4 and 5, thereby ensuring the electrical contact therebetween.

Figure 4:
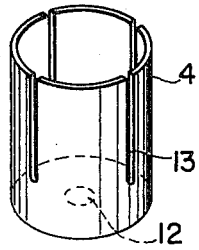
FIG. 4 is a perspective view showing an example of a first contactor for use in this invention.

FIG. 4 shows the case where four slits 13 are formed in the cylindrical body of the first contactor 4. The slits 13 are preferred to be formed as deep as possible in such a range as not to reach the position where the fusible member 7 is packed. Further, in this case, excellent results can be obtained by selecting the outer diameter of the second contactor 5 a little larger than the inner diameter of the first contactor 4.

Figure 5:
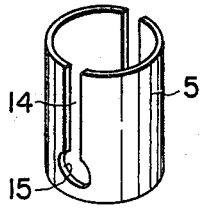
FIG. 5 is a perspective view illustrating an example of a second contactor for use in this invention.

FIG. 5 shows the case where two slits 14 are formed in the second contactor 5 diametrically opposite to each other. The slits 14 are formed to reach the closed end of the second contactor 5 and have circular hols 15 on the side of the closed end, permitting the cylindrical body of the second contactor 5 to greatly spread outwardly.

Figure 6:
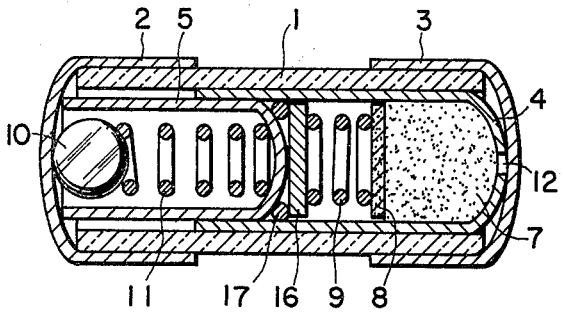
FIG. 6 is a sectional view showing another embodiment of this invention.
Figure 7:
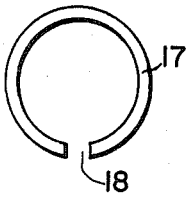
FIG. 7 is a plan view illustrating an example of a conductive ring used in the embodiment of FIG. 6.

Also, the contact resistance between the first and second contactors 4 and 5 can be reduced by an arrangement of the type shown in FIG. 6. That is, a conductive washer 16 is interposed between the closed end of the second contactor 5 and the first bias spring 9 and a conductive ring 17 is interposed between the conductive washer 16 and the closed end of the second contactor 5. For instance, as illustrated in FIG. 7, the conductive ring 17 is partly cut away, as indicated by 18, and has an outer diameter a little larger than the inner diameter of the first contactor 4. The ring 17 is interposed between the first and second contactors 4 and 5, with its outer edge held in sliding contact with the inner periphery of the first contactor 4, by which the contact pressure between the first and second contactors 4 and 5 can be decreased.

The thermal switch described above is of the type wherein the conductie caps 2 and 3 are held by a fuse holder, but it is also possible to produce a thermal switch of the type wherein lead wires are led out from the conductive caps. In this case, care should be taken that the contact resistance between the lead wire and the conductive cap is not changed by vibration or the like. Further, since the thermal switch proper is incorporated in a certain device, there is the fear that when a vibration or shock is applied to the thermal switch, its conductive caps 2 and 3 get in contact with other circuit elements.

Figure 8:
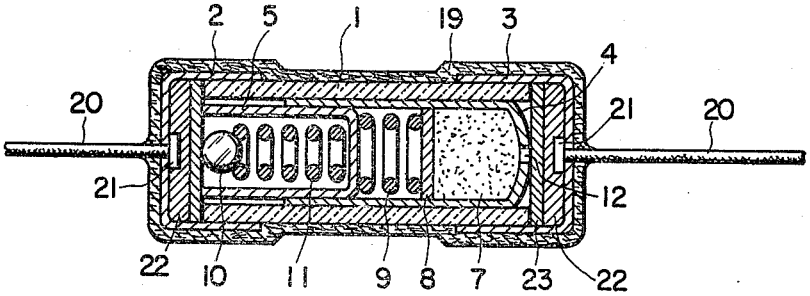
FIG. 8 is a sectional view showing still another embodiment of the thermal switch of this invention.

To avoid this, the thermal switch proper is coated over its entire surface with an insulating film 19 such as a transparent paint or the like, as shown in FIG. 8, so that even if the conductive caps 2 and 3 make contact with other circuit elements, short-circuiting is prevented by the insulating film 19. The coating of the insulating film 19 seals entirely the thermal switch to make it damp-proof to prevent the fusible member 7 from changing in quality. This prevents a change in the fusing temperature of the fusible member 7, and hence provides for highly enhanced reliability in the operation of the thermal switch. Further, for leading out the lead wires 20 from the conductive caps 2 and 3, a flange 21 is affixed at the end of each lead wire 20 and retained on the inner surface of the closed end of each of the conductive caps 2 and 3, and solder 22 is deposited on the back of the closed end of each conductive cap to cover the flange 21. Then, a conductive washer 23 is placed on the exposed surface of the solder 22, as shown.

In the prior art, the solder 22 is not provided and the washer 23 is pressed into each of the conductive caps 2 and 3, by which the flange 21 attached to the lead wire 20 is urged against the closed end of each conductive cap. With such a conventional structure, vibration applied to the thermal switch changes the contact state between the lead wire 20 and each of the conductive caps 2 and 3 to cause a change in the resistance value between the lead wires 20, resulting in an errous operation of, for instance, a fire detector circuit.

On the other hand, the deposition of the solder 22 ensures to interconnect the lead wire and each of the conductive caps 2 and 3, whereby to overcome the defect that the resistance value between the lead wires 20 is altered by vibration or the like.

The fusible member 7 is not limited specifically to the abovesaid paraffin, but may also be other substances such, for example, as tetraethyl thiuram disulfide, tetramethyl thiuram monosulfide, nicotine acid amide, diphenyl phenylenediamine, picramic acid or the like. When such a powder is used, dispersion in the fusing temperature can be suppressed lower than in the case of using paraffin. This will be described in connection with the case of employing, for instance, tetraethyl thiuram disulfide. The fusing temperature of this fusible substance is said to be 70° C. A method of testing a thermal switch is to leave it at a temperature lower than its operating temperature by 20° C. for 48 hours and measure the temperature of operation of the thermal switch while raising temperature at the rate of 1° C. per minute. In our experiments, ten thermal switches using tetraethyl tiuram disulfide were left at 50° C. for 48 hours and then the temperature was raised at the rate of 1° C. per minute. Two of the 10 thermal switches operated at 70° C., 5 at 68° C. and the remaining ones at 66° C., 67° C. and 69° C., respectively. In this case, it can be determined that the nominal operating temperature is 68° C. and that dispersion in the operating temperature is ±2° C. Such a range of dispersion might be said to be very small as dispersion in the operating temperature of the thermal switch of this kind. With the abovesaid various fusible substances, dispersion in the operating temperature falls within the range of ±4° C. at maximum and within ±1.5° C. at minimum. Accordingly, it is possible to obtain thermal switches of small dispersion in the operating temperature as a whole.

As has been described in the foregoing, the number of contactors used in this invention is only two, i.e. the first contactor 4 for housing the fusible member 7 and the second contactor 5 which moves to cut off the circuit when the fusible member 7 is liquefied. This naturally leads to reduction of the number of parts used, simplification of the assembling operation, and hence marked reduction of the manufacturing cost. Further, the formation of the hole 12 in the closed end of the first contactor 4 for housing the fusible member 7 facilitates a smooth discharge of the fused material to ensure cutting off of the circuit when the fusible member 7 is fused, thereby providing for enhanced reliability in the operation of the thermal switch.

It will be apparent that many modifications and variations may be effected without departing from the scope of the novel concepts of this invention.

What is claimed is:

1. A thermal switch comprising:

an insulating cylindrical member;

conductive caps attached to both ends of the insulating cylindrical member; a first cup-shaped contactor having its cylindrical body closed at one end and disposed in the insulating cylindrical member, with its closed end held in contact with one of the conductive caps;

a second cup-shaped contactor having its cylindrical body closed at one end and disposed in the first contactor, with its open end held in contact with the other conductive cap and the outer peripheral surface of its cylindrical body in sliding contact with the inner peripheral surface of the cylindrical body of the first contactor;

a fusible powder of an insulating material packed in the first contactor at the side of its closed end and fused at a predetermined temperature;

a cover for closing the fusible powder packing portion;

a first bias spring interposed between the cover and the second contactor for urging the open end of the second contactor against the other conductive cap;

an insulating spherical member disposed in the second contactor at the side of its open end; and a second bias spring interposed between the insulating spherical member and the closed end of the second contactor for applying a biasing force to the second contactor in the direction of the closed end of the first contactor, the second bias spring being set to present a biasing force smaller than that of the first bias spring while the fusible powder remains unfused;

wherein when the fusible powder remains unfused, the closed end of the first contactor and the open end of the second contactor are urged by the biasing force of the first bias spring against the conductive caps to electrically connect them to each other, and wherein when the fusible powder is fused and the compression stress applied to the first bias spring to reduce its biasing force smaller than that of the second bias spring, the second contactor is moved by the biasing force of the second bias spring into the first contactor to cut off the electrical connection between the second contactor and the conductive caps, thereby to electrically disconnect the conductive caps from each other.

2. A thermal switch according to claim 1, wherein a hole is formed in the closed end of the first contactor for discharging therethrough the fusible powder from the first contactor when the fusible powder is fused.

3. A thermal switch according to claim 1, wherein slits are formed in the cylindrical body of the first contactor in its axial direction, the cylindrical body of the first contactor being resiliently deformed in the radial direction thereof to resiliently contact the first and second contactors with each other to provide a contact pressure therebetween.

4. A thermal switch according to claim 1, wherein slits are formed in the cylindrical body of the second contactor in its axial direction, the cylindrical body of the second contactor being resiliently spread out to press its outer peripheral surface against the inner peripheral surface of the first contactor to provide a contact pressure therebetween.

5. A thermal switch according to claim 1, wherein a conductive ring is interposed between the closed end of the second contactor and the first bias spring at the side of the second contactor, with the marginal edge of the conductor ring held in sliding contact with the inner peripheral surface of the first contactor, and wherein a conductive washer is disposed between the closed end of the second contactor and the first bias spring at the side of the first bias spring.

6. A thermal switch according to claim 5, wherein the conductive ring is partly cut away and is deformable in its radial direction.

7. A thermal switch according to claim 1, wherein holes are each formed in the conductive caps, wherein lead wires are respectively led out through the holes in the axial direction of the insulating cylindrical member, wherein flanges are each attached to the end of the lead wire introduced in the conductive cap to retain thereat the end of the lead wire, wherein the flanges are each electrically and mechanically connected by a solder to the inner surface of the conductive cap, wherein a conductive plate is pressed in to cover the surface of the solder layer, and wherein the closed end of the first contactor and the open end of the second contactor are contacted with the conductive plate.

8. A thermal switch according to claim 7, wherein an insulating resinous material is coated over the peripheral surfaces of the insulating cylindrical member and the conductive caps.

* * * * *